US008524065B2

(12) United States Patent
Schwartz et al.

(10) Patent No.: US 8,524,065 B2
(45) Date of Patent: Sep. 3, 2013

(54) SYSTEMS AND METHODS FOR ELECTROCOATING A PART

(75) Inventors: Brent Allen Schwartz, Wapakoneta, OH (US); Brian Todd Young, Ada, OH (US)

(73) Assignee: Metokote Corporation, Lima, OH (US)

( * ) Notice: Subject to any disclaimer, the term of this patent is extended or adjusted under 35 U.S.C. 154(b) by 1171 days.

(21) Appl. No.: 12/233,952

(22) Filed: Sep. 19, 2008

(65) Prior Publication Data

US 2010/0072071 A1 Mar. 25, 2010

(51) Int. Cl.
*C25D 5/08* (2006.01)
*C25D 17/00* (2006.01)

(52) U.S. Cl.
USPC ..... 205/98; 205/148; 204/237

(58) Field of Classification Search
USPC ..... 205/98
See application file for complete search history.

(56) References Cited

U.S. PATENT DOCUMENTS

| | | | | |
|---|---|---|---|---|
| 2,750,332 | A * | 6/1956 | Miller | 205/118 |
| 3,896,010 | A * | 7/1975 | Vetter | 205/138 |
| 3,922,213 | A | 11/1975 | Smith et al. | |
| 4,119,522 | A * | 10/1978 | Brower et al. | 204/625 |
| 4,284,493 | A | 8/1981 | Case et al. | |
| 4,400,251 | A | 8/1983 | Heffner et al. | |
| 4,569,740 | A * | 2/1986 | Takahashi et al. | 204/502 |
| 5,164,056 | A * | 11/1992 | Loeck | 204/479 |
| 5,409,585 | A * | 4/1995 | Essary et al. | 427/476 |
| 5,468,361 | A | 11/1995 | Hess, Jr. et al. | |
| 5,591,316 | A | 1/1997 | Hess, Jr. et al. | |
| 5,641,849 | A * | 6/1997 | Nishida et al. | 528/10 |
| 2002/0027080 | A1 | 3/2002 | Yoshioka et al. | |
| 2002/0162749 | A1 | 11/2002 | Emmonds et al. | |
| 2005/0189231 | A1 | 9/2005 | Capper et al. | |
| 2007/0131542 | A1 * | 6/2007 | Hanson | 204/259 |
| 2007/0181169 | A1 | 8/2007 | Wallace et al. | |
| 2007/0261964 | A1 * | 11/2007 | Wilson et al. | 205/148 |

FOREIGN PATENT DOCUMENTS

| | | | |
|---|---|---|---|
| JP | 9287095 | A | 11/1997 |
| JP | 2006283137 | A | 10/2006 |

OTHER PUBLICATIONS

International Search Report and Written Opinion dated Apr. 7, 2010 pertaining to International application No. PCT/US2009/055368.

* cited by examiner

*Primary Examiner* — Jonathan Johnson
*Assistant Examiner* — Bryan D. Ripa
(74) *Attorney, Agent, or Firm* — Dinsmore & Shohl LLP

(57) ABSTRACT

Embodiments of systems and methods for electrocoating a part are presented herein. According to one embodiment, an electrocoating system comprises a tank, a pump in fluid communication with the tank, and an external anode positioned outside of the tank. The external anode is a substantially membrane-free metal pipe configured to provide an electric charge to a fluid for electrocoating a part. The system may further comprise one or more internal nozzles positioned inside of the tank to direct an electrically charged fluid from the pump into the tank for electrocoating a part. In addition, the system may further comprise one or more external nozzles positionable outside of the tank to direct an electrically charged fluid from the pump to one or more selected areas of a part positioned for electrocoating outside of the tank.

11 Claims, 3 Drawing Sheets

SYSTEMS AND METHODS FOR ELECTROCOATING A PART

SUMMARY

Embodiments of the present invention relate generally to systems and methods for electrocoating a part. More particularly, the embodiments relate to systems that are configured to electrically charge a fluid with an external anode positioned outside of an electrocoating tank. Thereby, the fluid is electrically charged by the anode before the fluid is delivered to the tank for electrocoating a part. The electric charging of the fluid by the external anode promotes equal charge distribution throughout the fluid before it is delivered to the tank. Equal charge distribution throughout an electrically charged fluid promotes uniform coating thickness of the fluid deposited on a part during an electrocoating process. In addition, the positioning of an anode outside, rather than inside, of the tank creates additional space inside of the tank for the electrically charged fluid and parts for electrocoating.

In accordance with one embodiment, an electrocoating system comprises a tank, a pump in fluid communication with the tank, and an external anode positioned outside of the tank. The pump is configured to deliver a fluid to the tank for electrocoating a part, while the external anode is configured to provide an electric charge to the fluid delivered by the pump.

In accordance with another embodiment, an electrocoating system further comprises one or more internal nozzles positioned inside of the tank and a return path extending from the tank to the pump. The one or more internal nozzles are configured to direct at least a portion of the electrically charged fluid from the pump into the tank to electrocoat a part, while the return path is configured to recycle the fluid from the tank to the pump. In addition, an external anode positioned outside of the tank comprises a substantially membrane-free metal pipe.

In accordance with yet another embodiment, a method of electrocoating a product comprises: providing an electrocoating system comprising a tank, a pump in fluid communication with the tank, an external anode positioned outside of the tank, and one or more internal nozzles positioned inside of the tank; positioning a part for electrocoating in the tank; delivering a fluid to the tank with the pump; electrically charging the fluid with the external anode; coating a part with the electrically charged fluid delivered by the one or more internal nozzles; and recycling the electrically charged fluid from the tank to the pump.

These and additional objects and advantages provided by the embodiments of the present invention will be more fully understood in view of the following detailed description, in conjunction with the drawings.

BRIEF DESCRIPTION OF THE DRAWINGS

The following detailed description of specific embodiments can be best understood when read in conjunction with the following drawings, where like structure is indicated with like reference numerals and in which.

Figure 1:
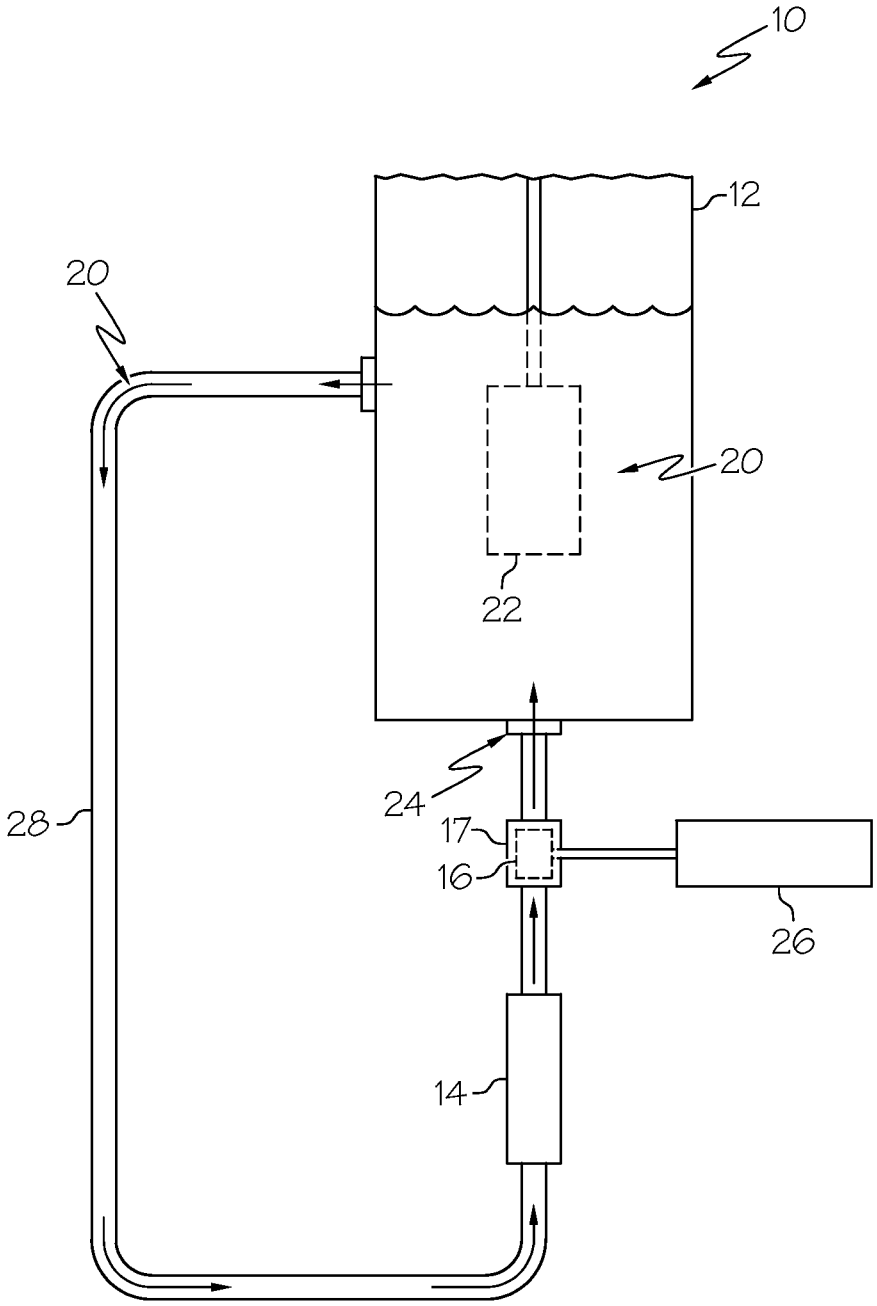
FIG. 1 is an illustration of an electrocoating system with an external anode positioned outside of a tank according to one embodiment of the present invention.

The embodiments set forth in the drawings are illustrative in nature and are not intended to be limiting of the invention defined by the claims. Moreover, individual aspects of the drawings and the invention will be more fully apparent and understood in view of the detailed description.

DETAILED DESCRIPTION

Referring initially to the embodiment shown in FIG. 1, an electrocoating system 10 generally comprises a tank 12, a pump 14, and an external anode 16. The tank 12 is configured to retain, at least temporarily, a fluid 20, or fluids, that is capable of carrying an electric charge. For example, the fluid 20 may be a ceramic, dye, pigment, or polymer, such as paint. Further, the tank 12 is configured to contain, at least partially, a part 22 for electrocoating. The tank 12 may be a closable and/or sealable structure to entirely contain a part 22 or may be open-ended to permit a portion of a part 22 to project there-from. In addition, a part 22 positioned in the tank 12 generally is stationary in the tank 12 during electrocoating, but it is contemplated that the part 22 may be conveyed through the tank 12 during electrocoating by a conveyor belt or other assembly. The part 22 for electrocoating may be a grounded electrical conductor and generally is substantially configured of a metallic substance. In one exemplary embodiment, the part 22 is a cathode. As such, an electrically charged fluid 20 is attracted to, and deposits on, the part 22. Equal, or substantially equal, charge distribution throughout the electrically charged fluid enhances the electrocoating process by generally providing a substantially uniform coating thickness of the fluid 20 deposited on the part 22.

As shown in FIG. 1, the pump 14 is in fluid communication with the tank 12. The pump 14 is configured to deliver a fluid 20 to the tank 12 for electrocoating a part 22. As such, the pump 14 is configured to deliver a fluid 20 to the tank 12 at a flow rate and pressure appropriate for electrocoating a part 22 as described herein. For example, but not by way of limitation, the pump delivers the fluid 20 to the tank 12 at a pressure from about 1 psi to about 50 psi, more particularly, from about 15 psi to about 40 psi, and at a flow rate from about 0.1 liters per second to about 3.0 liters per second. In one exemplary embodiment, the pump 14 is a centrifugal pump. It is contemplated, however, that any pump configured to perform the purposes stated herein may be utilized with embodiments of the electrocoating system 10.

The external anode 16 is positioned outside of the tank 12, generally between the pump 14 and the tank 12. The external anode 16 is configured to provide an electric charge to the fluid 20 delivered by the pump 14. As such, the external anode 16 provides the electric charge to the fluid 20 prior to its delivery into the tank 12 for electrocoating. The pump 14 generally delivers the fluid 20 past the external anode 16 to the tank 12 at a flow rate appropriate for the external anode 16 to sufficiently electrically charge the fluid 20. This flow rate of the fluid 20 delivered past the external anode 16 may vary depending upon a volume of the fluid 20 delivered by the pump 14. For example, it is contemplated that as a volume of the fluid 20 increases, a slower flow rate of the fluid 20 may be provided to increase a contact time between the fluid 20 and the external anode 16 and enable the external anode 16 to sufficiently electrically charge the fluid 20. The external anode 16 may be configured in any variety of shapes, such as, but not limited to, tubular, flat plate, C-shape, or annular, such as a pipe.

As shown in FIG. 1, the external anode 16 generally is contained within an insulating part 17. The insulating part 17 prevents a user of the electrocoating system 10 from being exposed to the electric charge of the external anode 16. In one exemplary embodiment, the insulating part 17 is a polyvinyl chloride (PVC) pipe in which the external anode 16 is contained. It is contemplated, however, that any insulating part configured to perform the purposes stated herein may be utilized with embodiments of the electrocoating system 10.

Further, it is common practice in the electrocoating industry that membranes may be used to cover anodes so as to remove acid from the fluid during the electrocoating of a part 22. Typically, about 80% of a surface area of an anode is covered by a membrane to control pH through acid removal. Membrane covered anodes generally are referred to in the industry as anolyte cells. An anode that is substantially membrane-free is one that may not be entirely free of a membrane, but that is membrane-free to an extent that any existing membrane does not interfere, to any significant degree, with the electric charging of the fluid by the anode. In one embodiment, the external anode 16 is membrane-free, or substantially membrane-free. In another embodiment, the external anode 16 is substantially covered by a membrane. In another embodiment, the electrocoating system 10 also comprises one or more internal anodes 18 positioned inside of the tank 12 to provide an additional electric charge to the electrically charged fluid 20 delivered to the tank 12. The internal anodes 18 also may be membrane-free, or substantially membrane-free, or substantially covered by a membrane.

In one embodiment, the external anode 16 comprises a membrane-free 316 type stainless steel pipe. Such anodes 16, by virtue of the fluid 20 passing through an enclosed channel of the metal pipe anode 16, are configured to provide substantially unlimited anode surface area in providing the electric charge to the fluid 20 as it passes through the anode 16. More particularly, the entirely exposed wall of the channel of the metal pipe external anode 16 may be unlimited in anode surface area in comparison to an internal anode positioned inside of a tank 12 where an anode surface area of the internal anode is limited by that portion of the anode positioned alongside of an interior wall of the tank 12. The unlimited anode surface area aids in the external anode 16 providing the electric charge substantially uniform to the fluid 20 so as to promote substantially equal electric charge distribution throughout the fluid 20. Substantially equal electric charge distribution throughout the fluid 20 optimizes the electrocoating of the part 22 by providing a substantially uniform attraction of molecules of the fluid 20 to the part 22. Further, it is contemplated that as a volume of the fluid 20 delivered to the external anode 16 by the pump 14 increases, a greater surface area of the external anode 16 may be provided to sufficiently electrically charge the fluid 20 delivered by the pump 14. Thus, it is contemplated that a minimum surface area of the external anode 16 per unit volume of fluid 20 flow may be provided to sufficiently charge the fluid 20 prior to its delivery to the tank 12 for electrocoating a part 22.

In one embodiment, shown in FIG. 1, with the external anode 16 being positioned outside of the tank 12, the system 10 comprises no anodes positioned inside of the tank 12. In another embodiment, however, shown in FIG. 2, the system 10 further comprises one or more internal anodes 18 positioned inside of the tank 12. As mentioned above, these internal anodes 18 may be configured to provide an additional electric charge to the electrically charged fluid 20 delivered to the tank 12 to ensure that the fluid 20 is sufficiently electrically charged for completion of the electrocoating process. Generally, the internal anodes 18 positioned inside of the tank 12 are substantially covered by a membrane. It is contemplated, however, that the internal anodes 18 inside of the tank 12 may be membrane-free or substantially membrane-free.

The electrocoating system 10 generally further comprises a direct current (DC) rectifier 26. The rectifier 26 generally is electrically coupled to the external anode 16 positioned outside of the tank 12, and, if present in the system 10, to the internal anodes 18 positioned inside of the tank 12, so as to provide an electric current to the anodes 16, 18 sufficient for the anodes 16, 18 to provide an electric charge to the fluid 20 at least adequate for electrocoating purposes. For example, but not by way of limitation, the electric current provided to the anodes 16, 18 may be, but is not limited to, from about 25 DC volts to about 600 DC volts or higher. The voltage provided to the anodes 16, 18 may vary according to a volume of the fluid 20 delivered by the pump 14. For example, a higher voltage may be provided to the anodes 16, 18 to sufficiently charge an increased volume and/or increased flow rate of the fluid 20 delivered by the pump 14. The electrocoating system 10 may also comprise any additional or other electrical circuitry desired or needed for embodiments of the electrocoating system 10 to perform the purposes stated herein.

Figure 2:
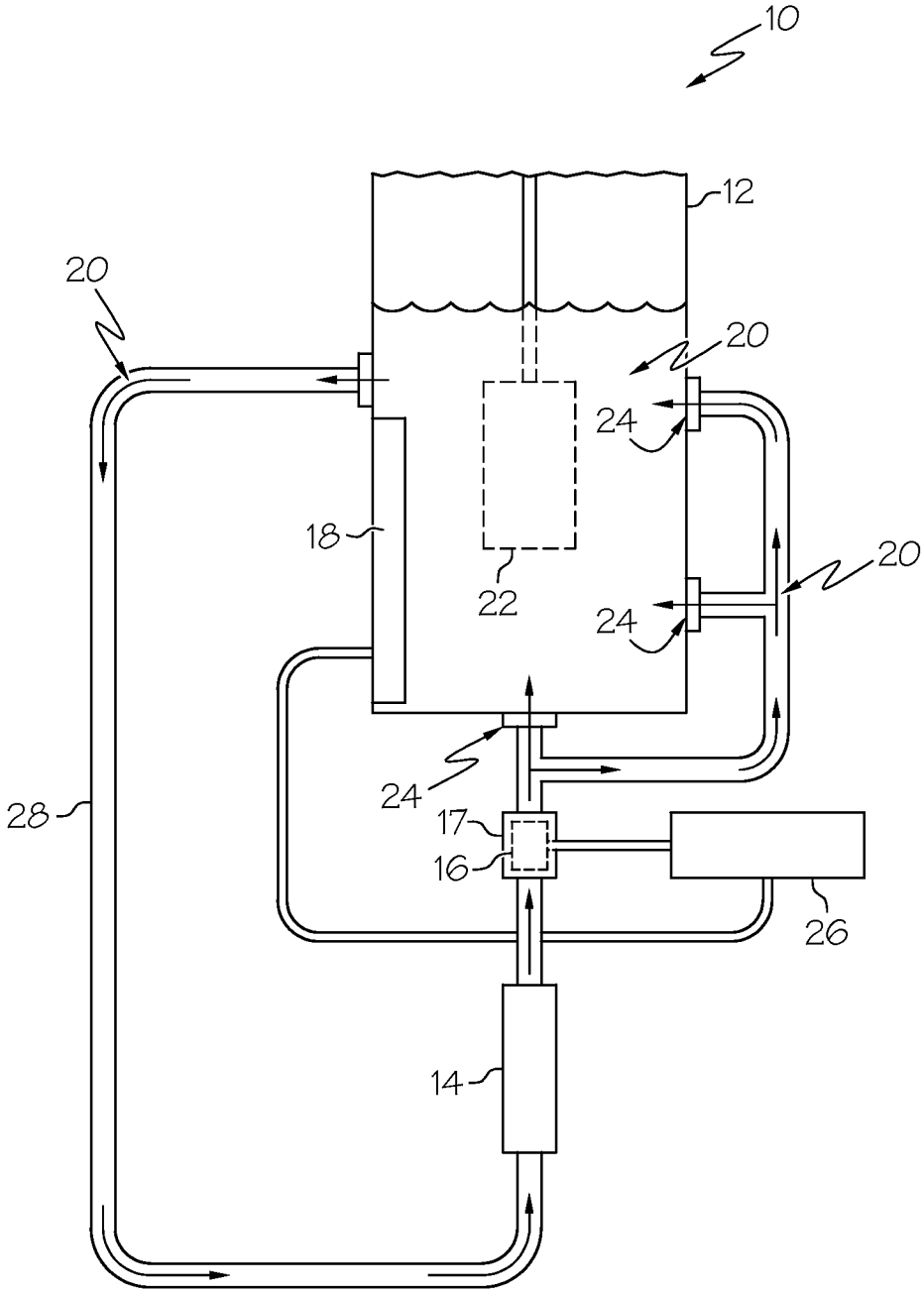
FIG. 2. is an illustration of an electrocoating system with an external anode positioned outside of a tank and internal nozzles positioned inside of the tank according to another embodiment of the present invention.

In one embodiment, shown in FIG. 1, the electrocoating system 10 may further comprise one or more nozzles 24 positioned inside of the tank 12 through which the pump 14 delivers the electrically charged fluid 20 to the tank 12. More particularly, the nozzles 24 are configured to direct at least a portion of the electrically charged fluid 20 from the pump 14 into the tank 12 for electrocoating a part 22. Further, as shown in FIG. 2, one or more of the internal nozzles 24 positioned inside of the tank 12 may be configured to direct at least a portion of the electrically charged fluid 20 from the pump to one or more selected areas of a part 22 positioned for electrocoating. The use of such nozzles 24 to direct an electrically charged fluid 20 to selected areas of a part 22 may substantially minimize variation in charge distribution in the electrically charged fluid 20 present throughout the tank 12 and, thereby, substantially optimize the electrocoating of both those selected areas of the part 22 and the part 22 in its entirety.

Figure 3:
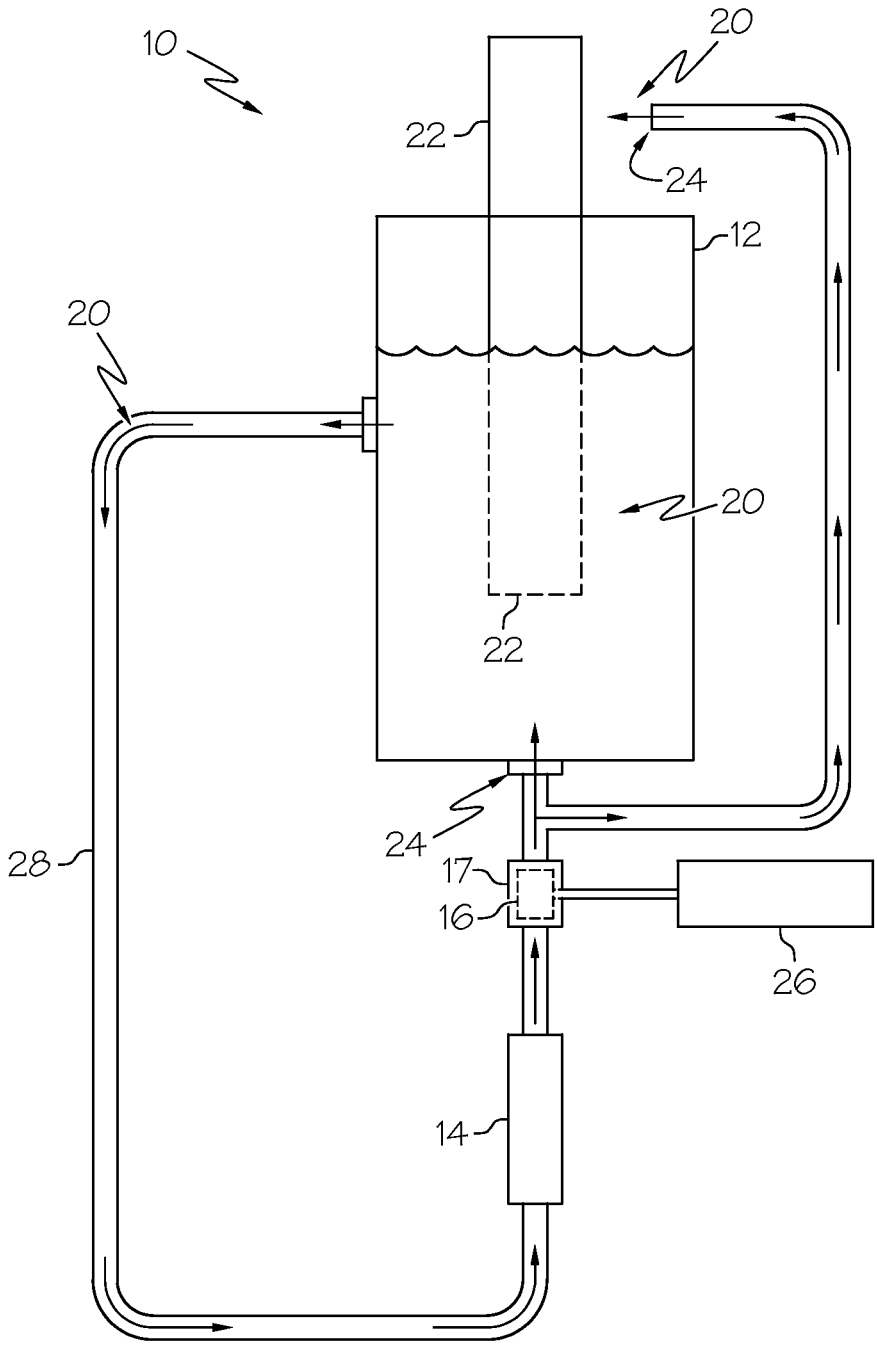
FIG. 3 is an illustration of an electrocoating system with an external anode and a nozzle, both positioned outside of a tank, according to another embodiment of the present invention.

In another embodiment, shown in FIG. 3, the electrocoating system 10 may further comprise one or more external nozzles 24 positioned outside of the tank 12 through which the pump 14 delivers the electrically charged fluid 20 for electrocoating a part 22. More particularly, the external nozzles 24 are configured to direct at least a portion of the electrically charged fluid 20 from the pump 14 to one or more selected areas of a part 22 positioned for electrocoating outside of the tank 12.

It is contemplated that, in another embodiment, the electrocoating system 10 may comprise one of any various combinations of embodiments of electrocoating systems 10, including, but not limited to, those embodiments described herein and shown in FIGS. 1-3. More particularly, an electrocoating system 10 may comprise one or more nozzles 24 positioned inside of the tank 12 configured to direct at least a portion of the electrically charged fluid 12 from the pump 14 into the tank 12 for electrocoating a part 22; one or more nozzles 24 positioned inside of the tank 12 and configured to direct at least a portion of the electrically charged fluid 20 from the pump 14 to one or more selected areas of a part 22 positioned for electrocoating; one or more nozzles 24 positionable outside of the tank 12 and configured to direct at least a portion of the electrically charged fluid 20 from the pump 14 to one or more selected areas of a part 22 positioned for electrocoating outside of the tank 12; or any combinations thereof.

As illustrated in FIGS. 1-3, the electrocoating system 10 generally also comprises a return path 28 that extends from the tank 12 to the pump 14. This return path 28 is configured to recycle the fluid 20 from the tank 12 to the pump 14. The return path 28 may comprise any combination of pipes, hoses, values, and any other fluid conveying devices configured to perform the purposes stated herein may be utilized with embodiments of the electrocoating system 10.

Further, it is contemplated that embodiments of the electrocoating system 10 may alternatively comprise and utilize a cathode, inside and/or outside of the tank 12, to provide an electric charge to the fluid 20 for electrocoating an anode part.

It is noted that recitations herein of a component of the present invention being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "generally" and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present invention or to emphasize alternative or additional features that may or may not be utilized in a particular embodiment of the present invention.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of electrocoating a product, wherein the method comprises:

providing an electrocoating system comprising a tank, a pump in fluid communication with the tank, an external anode positioned outside of the tank, one or more internal nozzles positioned inside of the tank, and a return path extending from the tank to the pump;

positioning a part for electrocoating in the tank;

delivering a fluid to the tank with the pump;

electrically charging the fluid with the external anode;

coating a part with the electrically charged fluid delivered by the one or more internal nozzles; and recycling the electrically charged fluid from the tank to the pump;

wherein:

the tank, the external anode, and the pump are directly coupled to form at least one continuous and uninterrupted loop configured for constrained flow of the fluid through the return path, pump, and external anode; and the external anode comprises a substantially membrane-free metal pipe configured to provide an electric charge to the fluid delivered by the pump.

2. The method of claim 1, further comprising electrically charging the electrically charged fluid with one or more internal anodes positioned inside of the tank.

3. The method of claim 1, further comprising directing at least a portion of the electrically charged fluid via the one or more nozzles to one or more selected areas of a part positioned for electrocoating.

4. The method of claim 1, further comprising:

providing one or more external nozzles positioned outside of the tank; and electrocoating one or more selected areas of a part positioned for electrocoating outside of the tank with the external nozzles positioned outside of the tank.

5. An electrocoating system comprising a tank, a pump in fluid communication with the tank, an external anode positioned outside of the tank, one or more internal nozzles positioned inside of the tank, and a return path extending from the tank to the pump, wherein:

the pump is configured to deliver a fluid to the tank for electrocoating a part;

the external anode comprises a substantially membrane-free metal pipe configured to provide an electric charge to the fluid delivered by the pump;

the one or more internal nozzles are configured to direct at least a portion of the electrically charged fluid from the pump into the tank to electrocoat a part;

the return path is configured to recycle the fluid from the tank to the pump; and the tank, the external anode, and the pump are directly coupled to form at least one continuous and uninterrupted loop configured for constrained flow of the fluid through the return path, pump, and external anode.

6. The electrocoating system of claim 5, further comprising one or more internal anodes positioned inside of the tank to provide an additional electric charge to the electrically charged fluid delivered to the tank.

7. The electrocoating system of claim 5, wherein the one or more internal nozzles are configured to direct at least a portion of the electrically charged fluid from the pump to one or more selected areas of a part positioned for electrocoating.

8. The electrocoating system of claim 5, wherein the system further comprises one or more external nozzles positioned outside of the tank and configured to direct at least a portion of the electrically charged fluid from the pump to one or more selected areas of a part positioned for electrocoating outside of the tank.

9. The electrocoating system of claim 5, wherein the external anode comprises a membrane-free 316 type stainless steel pipe.

10. The electrocoating system of claim 6, wherein the one or more internal anodes are substantially covered by a membrane.

11. The electrocoating system of claim 5, further comprising a rectifier electrically coupled to the external anode so as to provide an electric current to the external anode.

* * * * *